United States Patent [19]
Schulz
[11] 4,317,561
[45] Mar. 2, 1982

[54] HOLDER FOR AN OXYGEN LANCE

[76] Inventor: Manfred Schulz, Am Engsberg 4, 4030 Ratingen, Fed. Rep. of Germany

[21] Appl. No.: 161,172

[22] Filed: Jun. 19, 1980

Related U.S. Application Data

[63] Continuation of Ser. No. 966,443, Dec. 4, 1978, abandoned.

[30] Foreign Application Priority Data

Dec. 3, 1977 [DE] Fed. Rep. of Germany ..... 2753899
May 12, 1978 [DE] Fed. Rep. of Germany ..... 2820797
May 12, 1978 [DE] Fed. Rep. of Germany ..... 2820798

[51] Int. Cl.[3] ..... C21B 7/16

[52] U.S. Cl. ..... 266/265; 266/266; 266/267; 266/268; 266/269

[58] Field of Search ..... 266/265-269

[56] References Cited

U.S. PATENT DOCUMENTS 4,232,854 11/1980 Barbakadze ..... 266/266

*Primary Examiner*—P. D. Rosenberg
*Attorney, Agent, or Firm*—Sprung, Felfe, Horn, Lynch & Kramer

[57] ABSTRACT

A holder for an oxygen lance characterized by at least one actuating device comprising an operating lever which is connected to a shut off valve.

7 Claims, 7 Drawing Figures

HOLDER FOR AN OXYGEN LANCE

Figure 1:
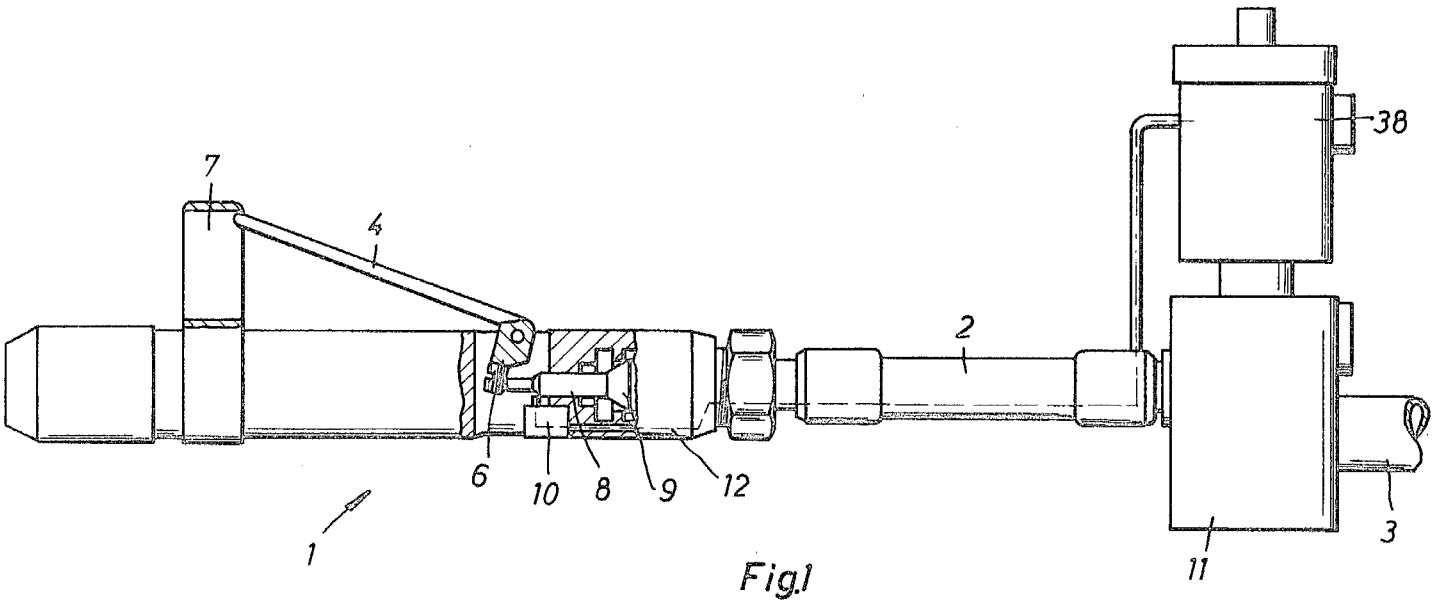

This is a continuation of application Ser. No. 966,443, filed Dec. 4, 1978, and now abandoned.

The invention relates to a holder for an oxygen lance, having a hose leading to the oxygen source and having a fast-closing valve between the hose and the oxygen source.

Holders for oxygen lances have a valve by which the oxygen being fed to the lance can be controlled. Even though the valve is securely closed, the full pressure still prevails in the oxygen hose between the valve and the oxygen source. This flexible oxygen hose, which is made, for example, of plastics or rubber, can come in contact with hot bits of metal during operation, resulting in the danger that it might be burned through, and the oxygen present in the hose might set off explosions or fires.

Furthermore, it is possible that slag might flow back through the lance into the holder, jamming the valve in the holder, and even leading to explosions. To prevent this, a device for safety from slag backflow is known from DE-PS No. 24 47 723, in which a forward binding point which is destructible by slag is disposed in the tubular body between the fast closing valve and the oxygen lance. For example, a wire sieve can be disposed in the tube cross section and a spacer set against the wire rope can hold the fast-closing valve in the open position against the force of a compression spring. When the wire screen is destroyed by the action of slag, the fast-closing valve closes. This design has reduced the hazards involved in burning with an oxygen lance, which might result from slag running back when the oxygen blow ends or is interrupted. Especially in the case of relatively large amounts of slag, the previously known design operates in a satisfactory manner.

The formerly known design, however, cannot reliably prevent [sic!] the prompt and rapid closing of the fast closing valve where smaller amounts of slag are involved, because the forward binding point has to be destroyed first by the action of the slag. In the period of time necessary for that purpose, however, slag can move back all the way to the oxygen hose, and explosions can occur since the oxygen hose is under a high pressure of oxygen.

The object of the present invention is to improve a holder of the above-mentioned kind such that, in the event of damage to the oxygen hose, uncontrollable fires or explosions are securely prevented.

It is also the object of the present invention to develop a means of safety against slag backflow which will produce a prompt shutoff of the oxygen supply even when the amounts of slag are small. Insofar as possible, the device for safety against slag backflow should be so designed that explosions in the area of the oxygen hose are prevented.

It is also an object of the invention to create an oxygen hose for a holder, such that, if it becomes damaged, it will insofar as possible reduce the danger of explosions.

These objects are achieved in accordance with the invention in that the holder has at least one device whereby the fast-closing valve can be actuated.

Advantageous developments of the invention are given in the subordinate claims.

Through the teaching of the invention, a very prompt closing of the fast-closing valve and a hose free of oxygen pressure are achieved. This signifies an important improvement of safety.

Suitable temperature sensors are especially measuring instruments which register very slight elevations of temperature. For example, a thermoelectric cell, a bimetal, but especially a thermistor, can be disposed in the base. These measuring instruments assure a closing of the fast-closing valve even upon a slight temperature elevation. The fast-closing valve can be disposed in the holder, as in the case of the formerly known embodiment. Particularly advantageous, however, is a design wherein the fast-closing valve is disposed between the oxygen source and the oxygen hose. The fixed pipeline is available for example, as the oxygen source during operation. If this oxygen source can be shut off by the fast-closing valve, the result is the great advantage that, after the closing valve has been actuated, no more oxygen gas can penetrate into the oxygen hose. In the prior-art construction, the oxygen hose was still under the high pressure of the oxygen source, so that, even though the valve was closed, explosions could take place in the area of the oxygen hose if hot materials came in contact with the oxygen hose from within or without. The valve is desirably in the form of a three-way valve, so that the oxygen remaining under high pressure in the hose after the closing of the valve will be able to escape to the atmosphere.

The oxygen hose consists usually of plastic or rubber. It has proven advantageous to carry the wire coming from the temperature sensor through the wall of the holder and through the wall of the oxygen hose to the fast-closing valve. This not only facilitates handling in operation, but additionally presents the advantage that a wire that is under measuring current will be damaged by the destruction of the oxygen hose and will automatically trigger the closing action. The wire carried through the oxygen hose constitutes a second defense against the dangerous explosions.

The special advantages of the device of the invention for safety against the backflow of slag is to be seen in the fact that the [fast-]closing valve is tripped even by slight temperature rises in the area of the base which provides good heat conductivity. The design is desirably selected such that, after the valve has shut, it can not open again, so that the operating personnel is obliged to install a new holder with antibacksflow safety. Thus accidents are virtually excluded, because even slight damage which is not externally visible can be detected by the safety system. Special advantages are offered by the design in which the cutoff valve is disposed in the vicinity of the oxygen source and the wire leading to the temperature sensor is carried through the oxygen hose. This design provides a two-fold security since the command to close the fast-closing valve can be given close to the holder and/or close to the oxygen hose.

The common plug part with the combined plug coupling provides the possibility of connecting up the gas and connecting up the conductor circuit by a single plug-in action, so that no errors of operation can occur. The actuating means is so constructed that the fast-closing valve [sic!] holds the fast-closing valve in the open position only when the connection is plugged in and the thermosensing circuit is energized.

The conductor loop can reach as far as the coupling part by which the oxygen hose is coupled to the holder. The possibility, however, also exists of carrying the conductor loop all the way into the holder and there providing at the end of the conductor circuit a temperature sensor which will extend into the open tube cross section and operate the tripping means due to temperature rise in the event of a slag backflow.

Figure 2:
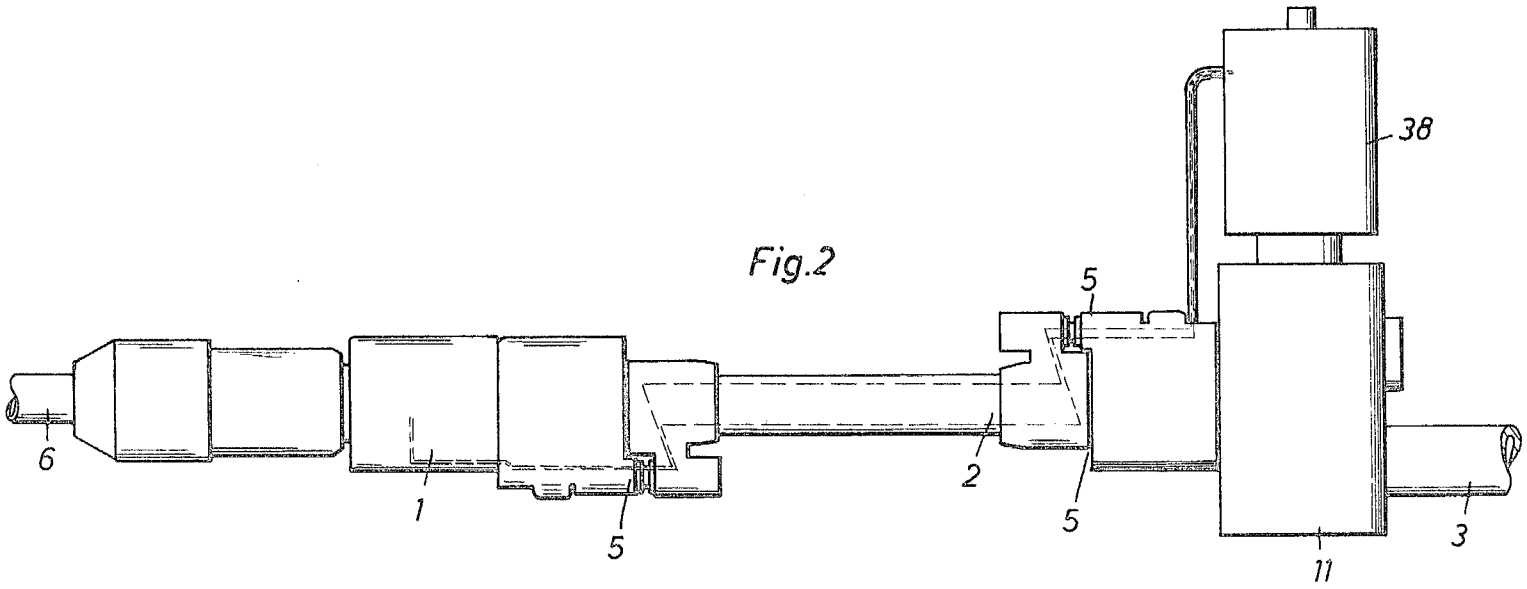
Figure 3:
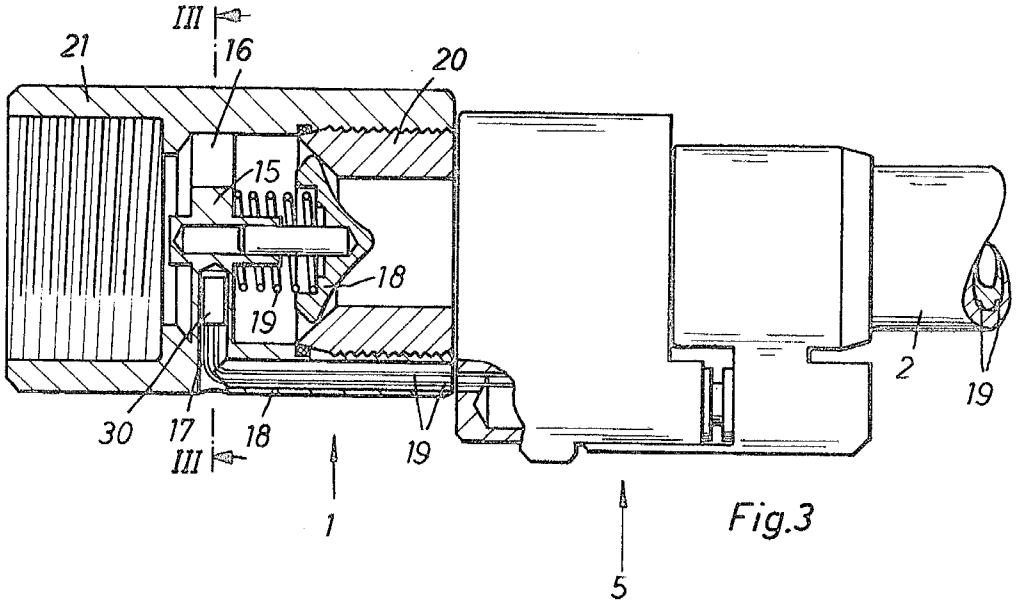
Figure 4:
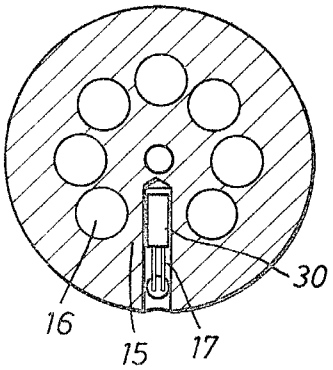
Figure 5:
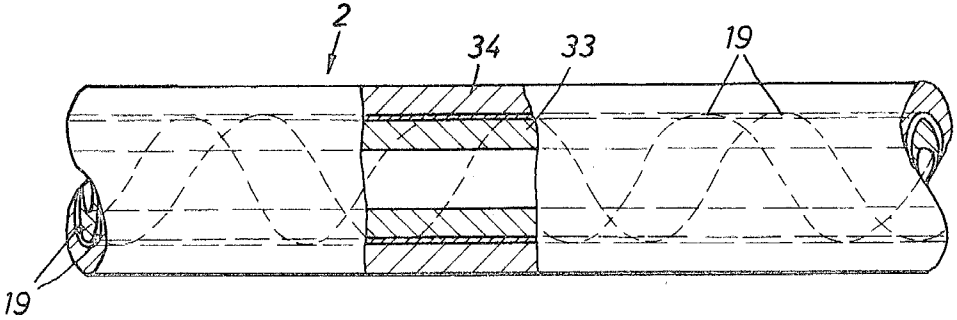
Figure 6:
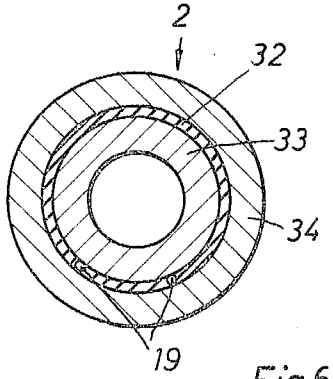
Figure 7:
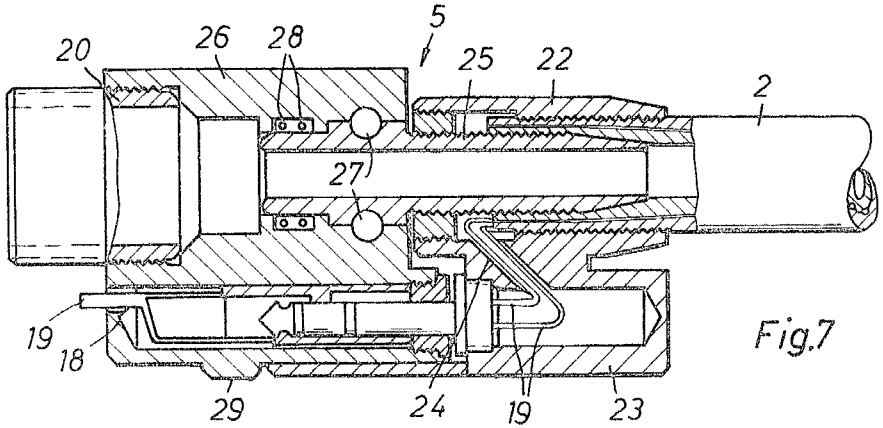

Examples of the invention will be explained below with the aid of the diagrammatic representations in the drawings wherein FIG. 1 is a side elevational view of a first embodiment, FIG. 2 is a side elevational view of a second embodiment, FIG. 3 is a partial longitudinal cross section taken through a portion of the mounting, FIG. 4 is a cross-sectional view taken along line III—III of FIG. 3, FIG. 5 is a longitudinal view, partially in cross section, of a portion of the oxygen hose, FIG. 6 is a cross-sectional view through the oxygen hose, and FIG. 7 is a longitudinal cross section of the coupling between the mounting and the oxygen hose.

The tubular lance holder 1 is connected by the oxygen hose 2 to the oxygen source 3. The oxygen source can be, for example, an oxygen pipeline present in the plant. The oxygen lance (not shown) is clamped in the front end of the lance holder 1. An operating lever 4 is pivoted on the lance holder 1 and has an elongated arm 5 protruding externally for operation by hand, and a short, bent-down lever arm 6 on the inside. The longer operating arm is guarded within a U-shaped loop 7 against accidental operation, as a safety measure.

As best seen in the cross-sectioned portion of FIG. 1, the short lever arm 6 engages the valve stem 8 which opens the way through the valve 9 to the oxygen hose 2. It is important that the short lever arm 6, when the operating arm 4 is in the closed position, acts upon the actuator 10, this being accomplished indirectly in FIG. 1 via the valve stem 8. The actuator 10 operates via the member 12, e.g., a mechanical pull cable or other conventional transmitting means or a transmission conductor, a fast-acting valve 11 disposed between the oxygen hose 2 and the oxygen source 3. The oxygen source 3 is commonly the oxygen pipeline present in the plant. The fast-acting valve 11 is in the form of a three-way valve such that, when safety valve 11 is closed, the oxygen present in the oxygen hose 2 can escape to the open air. When the safety valve is open, the oxygen can flow from the oxygen source 3 through the oxygen hose 2 and through valve 9 to the oxygen lance. The opening of the safety valve 11 takes place immediately upon the depression of the operating lever 4, since when the operating lever 4 is depressed, the valve stem 8 is no longer acts on the actuator 10 and thus the safety valve 11 opens. The design thus assures that, when the operating lever is in the closed position, accidents can no longer originate from the oxygen hose 2.

In a second embodiment, FIG. 2, illustrating the path of the oxygen, indicates the oxygen source 3, the fast-closing valve 11, a coupling 5, the oxygen hose 2, another coupling 5, the holder 1, and the oxygen lance 13.

As indicated in the enlarged representations in FIGS. 3 and 4, the holder 1 consists of a rear portion 20 leading to the coupling 5 and to the oxygen hose 2, and a front portion 21. The rear portion 20 can be closed off by a conical valve (explosion blocking valve) which is biased by the compression spring 19 and is opened by the oxygen pressure against the force of the compression spring 19.

The front portion 21 of the tubular body 1 serves to accommodate the rearward end of the oxygen lance 13. The oxygen lance 13 can be inserted into the front portion 21 no further than to the shoulder 14. Behind the shoulder 14, the base 15 is disposed in the free tubular cross section of the front portion 21. The base has oxygen gas passages 16 running longitudinally of the tubular body and a bore 17 extending radially outward. The bore 17 extends from the cylindrical wall of the front portion 21 to approximately the center of the tubular body. The bore 17, which has no opening to the interior of the tubular body, has an opening into a longitudinal bore 18 which is provided within the wall of the front portion 21. The bore 18 continues all the way into the coupling 5 and serves to accommodate two insulated wires 19, e.g., two insulated stranded copper conductors. The ends of wires 19 are connected to the two terminals on the rearward end of a temperature sensor 30 whose head is inserted into the bore 17. The temperature sensor 30 thus is situated approximately in the center of the tubular body's cross section and is sealed off from the interior of the holder 1 in a pressure-tight manner by the thermally conductive base. The thermally conductive base, however, can rapidly transfer the temperature of any backflowing slag to the head of the temperature sensor 12.

The insulated wires 19 extend from the coupling 5 through the oxygen hose 2 to the tripper of valve 11. As shown in FIGS. 5 and 6, the two wires 19 are vulcanized into the wall of the oxygen hose 2. They are situated in the area of the reinforcing fabric 32 between the internal rubber core 33 and the outer rubber jacket 34, and they are wound spirally around the rubber core 33, so that the wires 19 are able to follow unimpeded the movements of hose 2.

FIG. 6 shows that the holder is connected to the oxygen hose 2 by a combination plug coupling 5. The combination plug coupling 5 has a common plug member (plug or socket) for the gas line and for the insulated wires 19. In the embodiment shown in FIG. 6, the common plug member is fastened to the oxygen hose 2, while the common socket member is threaded into the rear portion 20 of the holder. The common plug member consists of a first plug portion 22 surrounding the hose and a second plug portion 23 disposed on its circumference. A passage 24 leads from the first plug portion 22 to the second plug portion 23. The two wires 19 are brought through this passage 24, so that the passage provides a communication from the wall of the oxygen hose 2 to the bore 18. The oxygen hose 2 is pressed against the inside wall of the first plug portion 22 by a threaded fitting 25, so as to provide a gas-tight seal. The portion of the hose fitting 25 that protrudes from the first plug portion 22 constitutes the plug of the coupling. This coupling plug engages the first socket portion 25 [26], and after insertion it is held in place by two pins 27. Two O-rings 28 serve as seals against the first socket portion 26. The second socket portion 29 is disposed on the circumference of the first socket portion 26, and serves to accommodate the electrical plug members required for the wires 13. As shown in the figure, the wires 19 are connected between the second plug portion 23 and the second socket portion 29 by a conventional electrical plug connection. The illustrated coupling makes it possible by means of a common plug and a common socket to connect the gas supply and the wire terminals 19 in a single plugging operation, thereby providing a gas-tight connection and at the same time a secure electrical connection for the circuit formed by the wires 13. As in the illustrated example, in which the common plug member is fastened to the end of the hose, it is possible for the common socket member to be fastened to the hose end, so that then the plug member would be provided on the holder 1. In this design alternative, the passage 24 is then to be provided in the common socket member fastened to the hose end. The snap-on coupling 5 described is advantageously provided also on the other end of the hose which is to be connected to the fitting leading to the fast-closing valve 11.

In practical use, the wires 19, which form a circuit with the temperature sensor 30, are carrying an explosion-proof measuring current. As soon as this current is changed beyond a threshold value, the actuator closes the fast-closing valve 11. This will come about if there is a backflow of slag that encounters the base 15 and thus produces an increase in the temperature of base 15. The highly thermoconductive base 15 immediately transfers the temperature elevation to the temperature sensor 30, so that the closing command is actuated. A closing of the fast-acting valve is thus produced by a backflow of even a small amount of slag. The closing can be signaled to the operating personnel visually by a light, so that even small damage which is externally imperceptible will be brought to the attention of the operating personnel by a luminous signal. Independently of this, the actuating device is so designed that, when the fast-acting valve 11 closes, it is necessary to attach a new holder 1 and, if necessary, a new oxygen hose 2, so that faulty equipment can no longer be used. If despite the provision of the sensitive temperature detector 30, small amounts of slag manage to reach the oxygen hose 2 or if, for example, hot pieces of iron or slag damage the oxygen hose 2 from without, a second defense is provided by the wires 19 running through the wall of the oxygen hose, since damage to the oxygen hose will necessarily damage the delicate wire 19, so that the interruption of the current will likewise produce a command for the closing of the valve 11.

The wires 19 can form a wiring loop extending to the vicinity of the coupling part 5 which forms the connection to the holder 1. It is also possible, however, to carry the conductor loop through the coupling 5 to the holder 1 as indicated in the diagrammatic representation in FIG. 2. In this embodiment it is advantageous to provide at the end of the conductor loop 19 in holder 1 a probe, e.g., a thermistor, a thermoelectric element or a bimetal element extending into the free tubular cross section and giving an actuating command to the actuator 38 on the basis of the temperature rise caused by backflowing slag.

I claim:

1. In a holder for an oxygen lance having a hose leading to an oxygen source and having a shut-off valve between said hose and said oxygen source, the improvement wherein said holder has at least one actuating device connected to said shut-off valve, said actuating device comprising an operating lever, said operating lever itself comprising a short, bent-down lever within said holder, said short, bent-down lever connected to a valve stem within said holder, said bent-down lever connected to a manually operable long lever arm disposed outside said holder, said valve stem opening the way through a second valve to said hose, said bent-down lever arm, when said long arm is in closed position, connected to and acting upon an actuator which, in turn, indirectly acts on said shut-off valve.

2. A holder according to claim 1 wherein said short, bent-down lever arm acts on said actuator via said valve stem.

3. Holder of claim 1 further comprising a tripping device operable by slag flowing back in the oxygen lance.

4. Holder of claim 3, characterized in that the device has a plate-like base of thermoconductive material having passages for the oxygen gas and a temperature sensor for the actuation of the shut-off valve.

5. Holder of claim 4, characterized in that the temperature sensor is disposed in a bore extending from the cylindrical wall toward the center.

6. Holder of claim 1 wherein in the wall of the hose disposed between the holder and the shut-off valve, a conductor loop is embedded, which extends over the length of the hose as a current-carrying measuring loop for said actuator of the shut-off valve.

7. Holder of claim 6, characterized in that, of the two hose extremities, at least the one fastened to the shut-off valve is equipped with a coupling having in a common plug member (plug or socket) a first portion and on its periphery a second portion into which the conductor loop passes through a passage between the first portion and the second portion.

* * * * *